US005178065A

United States Patent [19]

Reder et al.

[11] Patent Number: 5,178,065

[45] Date of Patent: Jan. 12, 1993

[54] CHAMBERED DOCTOR BLADE

[75] Inventors: Wolfgang O. Reder, Veitshöchheim; Dieter Reinhart, Hettstadt; Georg Schneider, Würzburg, all of Fed. Rep. of Germany

[73] Assignee: Koenig & Bauer Aktiengesellschaft, Wurzburg, Fed. Rep. of Germany

[21] Appl. No.: 895,014

[22] Filed: Jun. 8, 1992

[30] Foreign Application Priority Data

Jun. 5, 1991 [DE] Fed. Rep. of Germany ..... 4118426

[51] Int. Cl.[5] ..... B41F 9/10

[52] U.S. Cl. ..... 101/169; 101/116; 15/236.1; 118/261

[58] Field of Search ..... 101/114, 116, 119, 120, 101/169, 157, 364, 365; 15/256.5, 236.1; 118/261, 262

[56] References Cited

U.S. PATENT DOCUMENTS

| | | | |
|---|---|---|---|
| 3,815,499 | 6/1974 | Adler | 101/157 |
| 4,461,211 | 7/1984 | Wesselman | 101/169 |
| 4,821,672 | 4/1989 | Bruno | 118/261 |
| 5,014,616 | 5/1991 | Tapper | 101/157 |
| 5,027,513 | 7/1991 | Allison, Jr. | 15/256.51 |
| 5,080,013 | 1/1992 | John | 101/169 |
| 5,097,762 | 3/1992 | Nakano et al. | 101/157 |
| 5,125,341 | 6/1992 | Yaesno | 101/169 |

FOREIGN PATENT DOCUMENTS

| | | | |
|---|---|---|---|
| 3909878 | 3/1989 | Fed. Rep. of Germany . | |
| 0047618 | 3/1982 | European Pat. Off. | 101/169 |
| 999320 | 7/1965 | United Kingdom | 101/365 |

*Primary Examiner*—Eugene H. Eickholt
*Attorney, Agent, or Firm*—Jones, Tullar & Cooper

[57] ABSTRACT

A chambered doctor blade utilizes parallel, axially extending spaced working and sealing doctor blades, together with spaced end plates to define an ink chamber. Free axial ends of the working doctor blade extend beyond the ends of the end plates and remove built-up ink beads. This removed ink flows down the surface of the inwardly inclined end plates.

1 Claim, 1 Drawing Sheet

CHAMBERED DOCTOR BLADE

FIELD OF THE INVENTION

The present invention is directed generally to a chambered doctor blade. More particularly, the present invention is directed to a chambered doctor blade for an inking system. Most specifically, the present invention is directed to a chambered doctor blade for an inking system of a rotary printing press. The chambered doctor blade is utilized with a screened surface ink roller to transfer ink to the surface of the screen roller and thence to one or more printing plates. The ink chamber is defined by a working doctor blade, a sealing doctor blade and two spaced end plates. The working doctor blade extends axially beyond the end plates and prevents beads of ink from forming on the screen roller.

DESCRIPTION OF THE PRIOR ART

Chambered doctor blade assemblies are generally known in the art and are typically used with an ink roller, such as a screen surface ink roller, to supply printing ink to a plate cylinder. The chambered doctor blade has an ink chamber which is formed by generally parallel, spaced working and sealing doctor blade that extend in the axial direction of the ink roller, and by axially spaced end plates or parting plates which are generally perpendicular to the two doctor blades. Ink supplied to the ink chamber of the chambered doctor blade is applied to the screened surface ink roller as it passes through the ink chamber. Excess ink is scraped off the ink roller by the doctor blade.

In the prior art devices a bead of ink has been apt to form in front of the end or sealing doctor blade and this bead of ink has been carried forward, in the direction of rotation of the ink roller past the working doctor blade. Such a bead of ink can cause blots or other printing errors in the printed product since the beads of ink are transferred from the screen roller along to the printing plates. This is particularly significant problem when different ink colors are being used next to each other on the same screen roller.

One prior attempt to correct this problem of the formation of beads of ink at the ends of the sealing doctor blade has been the forming of grooves or recesses on the periphery of the inking roller. The ink beads that accumulate are pushed into these grooves. However, the disadvantage of this prior solution is that the grooved ink roller cannot be used in various printing devices, such as panorama printing devices.

In German patent No. DE PS 39 09 878 there is shown a chambered doctor blade in which the working doctor blade is longer than the end or sealing doctor blade. This structure has lessened the formation of beads of ink on the screen roller. A limitation of this prior device is that ink accumulates in a wedge formed by the drain plate and the side wall at both ends of the working doctor blade. Since the printing ink is apt to be thixotropic, it hardens and hinders the flow of ink behind it. In addition, it is difficult to clean this prior art device.

It will thus be apparent that a need exists for a chambered doctor blade which overcomes the limitations of the prior art devices. The chambered doctor blade in accordance with the present invention provides such a device and is a significant improvement over the prior art devices.

SUMMARY OF THE INVENTION

It is an object of the present invention to provide a chambered doctor blade.

Another object of the present invention is to provide a chambered doctor blade for an inking system.

A further object of the present invention is to provide a chambered doctor blade for an inking system of a rotary printing press.

Still another object of the present invention is to provide a chambered doctor blade which prevents the formation of ink beads.

Yet a further object of the present invention is to provide a chambered doctor blade which prevents transfer of ink beads to the ink roller from the screen roller.

Even still another object of the present invention is to provide a chambered doctor blade which prevents blots and imperfections in the printed image.

As will be discussed in greater detail in the description o the preferred embodiment which is set forth subsequently, the chambered doctor blade in accordance with the present invention utilizes spaced working and end doctor blades in conjunction with spaced end plates. The working doctor blade has free ends that extend in the axial direction of the screen roller beyond the end or separating plates. The lower ends of the separating plates are also inclined inwardly into the ink chamber of the chambered doctor blade and have drain slits or slots.

The chambered doctor blade of the present invention is particularly effective in removing or wiping the laterally spaced ink beads off the surface of the screen roller. This is due to the extension of the ends of the working doctor blade in an unsupported manner beyond the ends of the end doctor blade. The beads of ink which are prevented from forming by the working doctor blade run down the side of the angled end or separating plates and return to the ink reservoir without splashing. The ink does not accumulate in corners and does not harden in hard to reach areas so that cleaning is more readily accomplished.

The separating or end plates of the chambered doctor blade of the present invention are provided with slots in their lower portions. These slots assure that excess ink pressure in the ink chamber is kept within the specified rang and thus the ink does not become overly pressurized in areas where this is not desired.

The chambered doctor blade in accordance with the present invention overcomes the limitations of the prior art devices and provides an assembly that is a substantial advance in the art.

DESCRIPTION OF THE DRAWINGS

While the novel features of the chambered doctor blade in accordance with the present invention are set forth with particularity in the appended claims, a full and complete understanding of the invention may be had by referring to the detailed description of the preferred embodiment, which is set forth subsequently, and as illustrated in the accompanying drawings, in which:

DESCRIPTION OF THE PREFERRED EMBODIMENT

Figure 2:
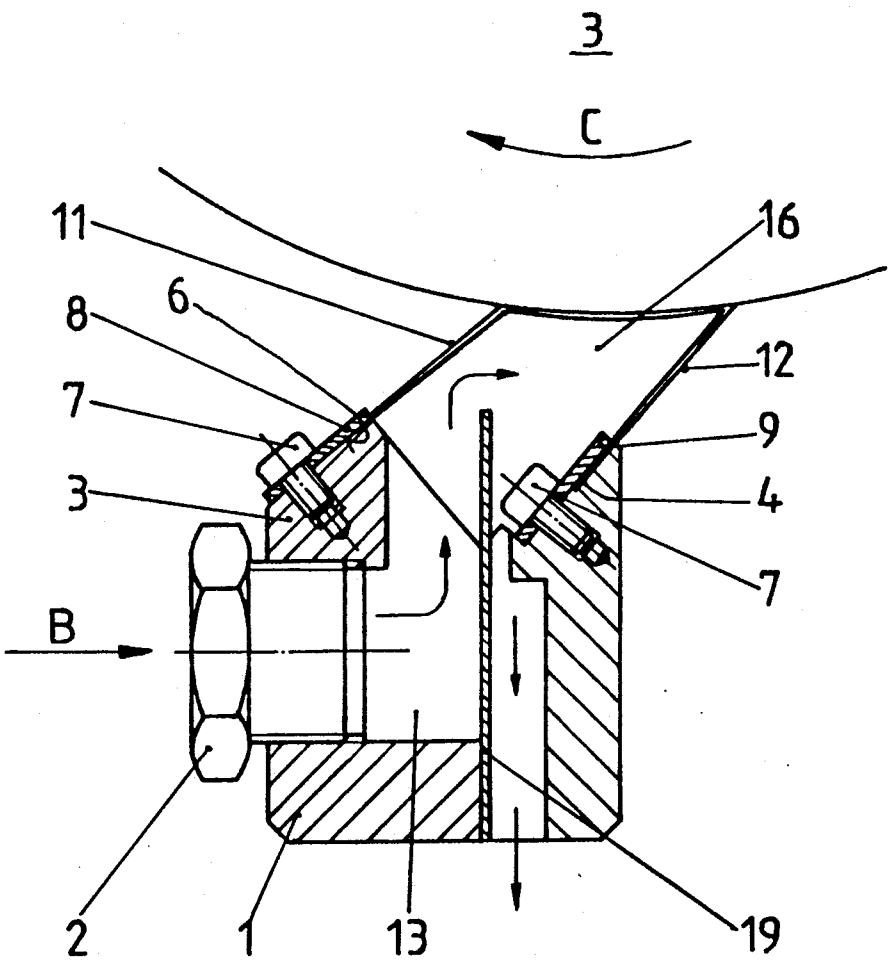
FIG. 2 is a cross-sectional view through the chambered doctor blade and seen in the direction indicated by arrow A in FIG. 1.
Figure 1:
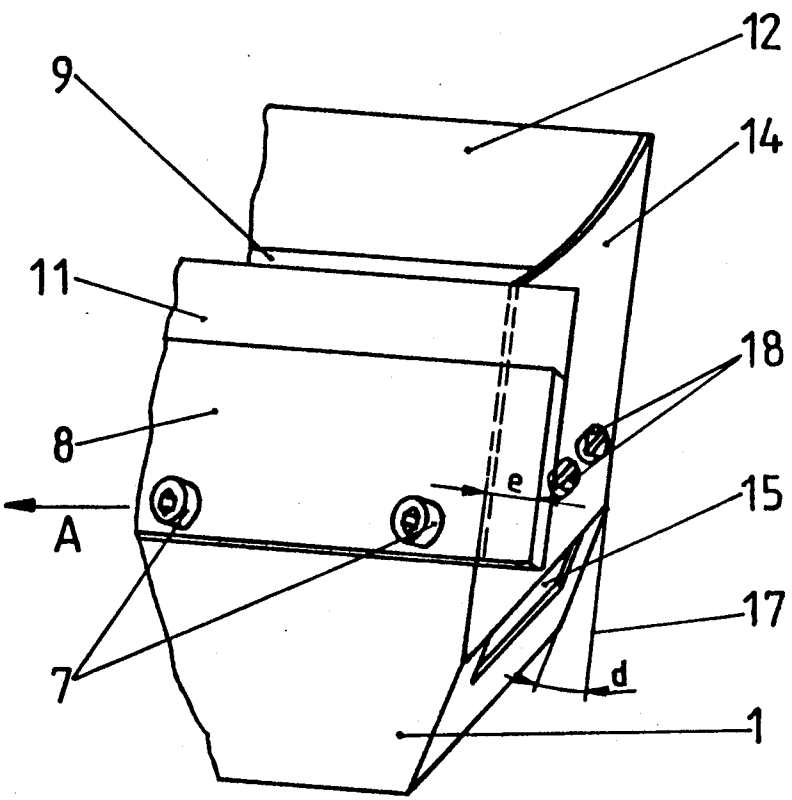
FIG. 1 is a partial perspective view of a chambered doctor blade in accordance with the present invention.

Referring now to FIGS. 1 and 2, there may be seen a preferred embodiment of a chambered doctor blade in accordance with the present invention. The chambered doctor blade has a base body 1, which can be of one piece, or for the purpose of facilitating cleaning, can be of two piece construction. A two piece base body 1, not specifically shown, would be divided in the axial direction of a screen roller 3 with which the chambered doctor blade cooperates.

As may be seen in FIG. 2, a connector 2 is attached to the base body 1 and is used to supply ink to the chambered doctor blade from a suitable ink fountain, not shown. Ink flows through ink supply connector 2 in the direction indicated by arrow B in FIG. 2.

The base body 1 extends in the axial direction of, and parallel to the screen roller 3 which is rotatable in the direction indicated by arrow C in FIG. 2. Upper surfaces 4 and 6 of the base body 1 are inclined and carry retaining strips 8 and 9. These retaining strips 8 and 9 are secured to the inclined faces 4 and 5 by suitable screws 7. A working doctor blade 11 is secured between inclined surface 6 and retaining strip 8 while a sealing or end doctor blade 12 is secured between inclined surface 4 and retaining strip 9. An ink receiving chamber 13 is formed in the base body 1 of the chambered doctor blade by the cooperation of the working doctor blade 11, the sealing or end doctor blade 12 and spaced separating or end plates 14 and 16.

Referring now primarily to FIG. 1, it may be seen that the separating or end plate 14 has a lower portion which is angled inwardly into the base body 1 at an angle "d" with respect to the perpendicular, as indicated at 17. The inclination of the lower ends of the end plates 17 and 16 are axially inwardly toward the center of the ink chamber 13. Each of the separating or end plates 14 and 16 is provided with a drain slit 15 in its angled portion. These drain slits 15 are sized so that the ink pressure in the ink chamber 13 will not increase above a certain level. Any ink passing out through the ink slits 15 will drain back into the ink fountain which cooperates with the chambered doctor blade. Suitable screws 18 are used to secure the end or separating plates 14 and 16 to the base body 1 of the chambered doctor blade.

Referring again to FIG. 1, it may be seen that the working doctor blade 11 extends axially beyond the ends of the base body 1. The extent of this extension is indicated at "e". Thus the working doctor blade 11 has a free length which is greater than that of the end doctor blade by an amount of two times "e". The retaining strip 8 has a length corresponding to the length of the working doctor blade 11.

Returning to FIG. 2, ink flows through the ink supply connector 2 into the ink chamber 13 in the base body 1. The ink chamber 13 can be partially divided by a divider strip 19 which has a free end that extends upwardly in the ink chamber 13 toward the screen roller 3. This divider strip 19 assists in reducing or preventing the formation of vortices in the ink in the ink chamber 13 as the surface of the screen roller 3 passes through the upper part of the ink chamber 13.

As the screen roller 3 rotates in the direction indicated by arrow C, ink is carried out of the ink chamber 13 by the screened surface of the roller 3 and is scraped off by the working doctor blade 11. Ink beads that form exteriorly of the separating or end plates 14 and 16 are captured by the outer ends of the working doctor blade 11 which extend axially beyond the end plates 1 and 16 by the distance *2e*. The ink collected from these ink beads runs down the inwardly tapering end plates 14 and 16 and falls into the ink funnel (not shown) which cooperates with the chambered doctor blade. The removal of these ink beads prevents them from causing a reduction in the quality of the printed product since the ink splashes or blots that have occurred, particularly during printing operations using multiple colors on one screen roller, are eliminated.

While a preferred embodiment of a chambered doctor blade in accordance with the present invention has been set forth fully and completely hereinabove, it will be apparent to one of skill in the art that a number of changes in, for example, the size of the screen roller, the length of the chambered doctor blade, the type of ink used and the like may be made without departing from the true spirit and scope of the subject invention which is accordingly to be limited only by the following claims.

What is claimed is:

1. A chambered doctor blade for an inking system of a rotary printing machine usable for applying ink to a screen roller beneath which said chambered doctor blade is positionable, said chambered doctor blade comprising:

a base body having an ink chamber;

a working doctor blade and an end doctor blade, both said working and end doctor blades being secured to said base body and extending generally parallel to and spaced from each other in an axial direction of the screen roller, both said working and end doctor blades having upper edges engageable with the screen roller;

first and second spaced separating plates axially spaced at first and second ends of said base body, each of said first and second separating plates having an inwardly inclined lower surface portion directed axially inwardly, each of said inwardly inclined lower surface portions of said first and second separating plates having a drain slit; and first and second free ends of said working doctor blade, said first and second free ends extending axially outwardly beyond said first and second spaced separating plates, said first and second free ends of said working doctor blade removing ink bead from the screen roller, said removed ink beads flowing down said separating plates.

* * * * *